US005477231A

United States Patent [19]

Medard

[11] Patent Number: 5,477,231

[45] Date of Patent: Dec. 19, 1995

[54] MICROSTRIP ANTENNA DEVICE, PARTICULARLY FOR A UHF RECEIVER

[75] Inventor: Joël Medard, Bievres, France

[73] Assignee: Dassault Electronique, Saint Cloud, France

[21] Appl. No.: 190,443

[22] Filed: Feb. 2, 1994

[30] Foreign Application Priority Data

Feb. 4, 1993 [FR] France ..... 93 01248

[51] Int. Cl.[6] ..... H01Q 21/06

[52] U.S. Cl. ..... 343/700 MS; 343/778; 343/789

[58] Field of Search ..... 343/700 MS, 778, 343/789; H01Q 1/38, 21/06, 13/08

[56] References Cited

U.S. PATENT DOCUMENTS 4,963,892 10/1990 Matsuo et al. ..... 343/700 MS
5,061,938 10/1991 Zahn et al. ..... 343/700

FOREIGN PATENT DOCUMENTS 0384780 8/1990 European Pat. Off. .
0427479 5/1991 European Pat. Off. .
0221007 12/1984 Japan ..... 343/700 MS
0141007 5/1990 Japan ..... H01Q 13/08
0262703 10/1990 Japan ..... 343/700 MS

OTHER PUBLICATIONS

Patent Abstracts of Japan, vol. 011, No. 338 (E–553) Nov. 5, 1987.

Murata, T. et al., "A Printed Antenna with Two–Layer Structure for Satellite Broadcast Reception", *Electronics and Communications in Japan,* Part 1, vol. 73, No. 4, Apr. 1990, pp. 81–90, New York, U.S.

*Primary Examiner*—Donald T. Hajec
*Assistant Examiner*—Tho Phan
*Attorney, Agent, or Firm*—Foley & Lardner

[57] ABSTRACT

A microstrip antenna device having a dielectric layer, a conductive patch of a chosen shape on one side of the layer and, on the other side of the layer, a conductive plate forming a ground plane; and, a feed circuit comprising at least one microstrip line connected to the conductive patch and implanted in the dielectric layer in the same plane as the conductive patch. The thickness of the dielectric layer opposite the microstrip line is greater than the thickness opposite the periphery of the microstrip line. Further, the thickness of the dielectric layer opposite the conductive patch is greater than the thickness opposite the microstrip line, and also greater than the thickness opposite the periphery of the conductive patch.

11 Claims, 3 Drawing Sheets

MICROSTRIP ANTENNA DEVICE, PARTICULARLY FOR A UHF RECEIVER

BACKGROUND OF THE INVENTION

This invention relates to microstrip antenna devices, and finds particular application in the UHF reception of satellite television signals.

As is known, a microstrip antenna device has a radiating structure comprising:

a dielectric layer, a conductive patch of a chosen shape on one side of the dielectric layer, and on the other side of the conductive layer a conductive plate forming a ground plane, and a feed circuit defining the mode of feeding UHF energy to the radiating structure and comprising, for example, at least one microstrip line connected to the conductive patch and implanted in the dielectric layer in the same plane as the conductive patch.

A person skilled in the art will know that, for a given dielectric constant, the geometric dimensions of the conductive patch determine the centre operating frequency of the antenna device, and that the thickness of the said dielectric layer is substantially proportional to the usable frequency bandwidth.

Thus, in order to keep a predetermined usable frequency bandwidth, it is necessary to determine a corresponding thickness of the dielectric layer.

The usable frequency bandwidth, in the field of telecommunications antennae, necessitates a thickness of the dielectric layer such that, if it is intended to produce microstrip lines with an impedance of 50 ohms, the width of the latter is significant, for example a width of 20 mm for a thickness of 5 mm of air.

The use of such a line width gives rise to drawbacks, in particular in the implantation of the feed distributor when the antenna device comprises a network of conductive patches as well as in the production of the resistive couplers in microstrip feed lines. It also gives rise to a greater amount of spurious radiation.

One solution in such a case consists of working with a line impedance of a value above 50 ohms, for example 70 ohms, but it has the disadvantage of requiring adaptor sections which are cumbersome and difficult to use.

The invention provides a satisfactory solution to this problem in a microstrip antenna device of the type described above.

BACKGROUND OF THE INVENTION

According to a general definition of the invention, the thickness of the dielectric layer opposite the microstrip line is greater than the thickness opposite the periphery of the microstrip line.

Such an adaptation of the thickness of the dielectric layer, in accordance with the radioelectrical area facing the said layer, makes it possible to avoid the use of wide microstrip lines, which consequently assists feed distributor implantation in an antenna device comprising a network of radiating conductive patches.

Preferably, the thickness of the dielectric layer opposite the conductive patch is greater than opposite the periphery of said conductive patch, and the thickness of the dielectric layer opposite the conductive patch is greater than opposite said line.

In practice, the patch is of generally circular or rectangular shape.

According to one aspect of the invention, the conductive patch and its associated microstrip line are etched in a printed circuit metallised on a single face, the said patch and line being in contact with the dielectric layer.

Such an embodiment has the consequence of putting the substrate of the printed circuit above the patch and its line with respect to the ground plane, which confers two advantages.

First of all, the substrate can act as a protective radome.

Further, the substrate suffers less from dielectric losses, which makes it possible to use less expensive substrates which are not dedicated to UHF applications.

Advantageously, the substrate of the printed circuit is a material based on glass fabric impregnated with epoxy-type resin, which is very widely used in low-frequency applications.

According to a preferred embodiment of the invention, the conductive plate forming the ground plane consists of an embossed metal plate opposite the conductive patch and microstrip line.

The metal plate can, for example, be a dished metal sheet.

According to a preferred characteristic of the invention, the dielectric layer consists of air.

According to one application of the invention, the device comprises a network of patches with their associated microstrip lines, implanted in the same printed circuit.

Advantageously, in the UHF receiver application, the antenna device is associated with a frequency converter conferring on it the function of a UHF receiver of satellite television signals.

Other characteristics and advantages of the invention will become clear in the light of the following detailed description and the accompanying drawings.

DETAILED DESCRIPTION OF PREFERRED EMBODIMENTS

Figure 1:
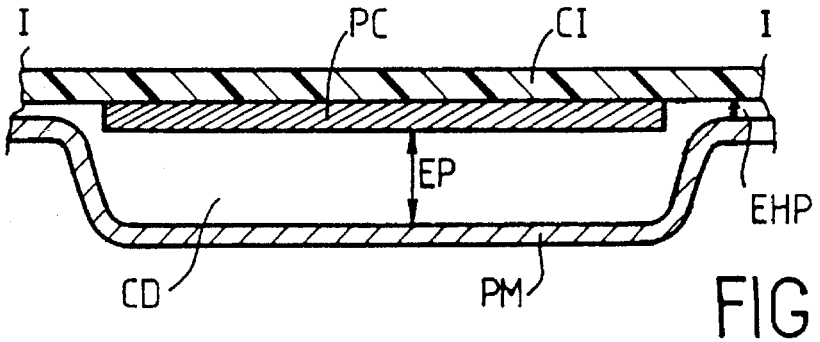
FIG. 1 is a partial cross sectional view, along the section line I—I (FIG. 4), of a conductive patch according to the invention.
Figure 2:
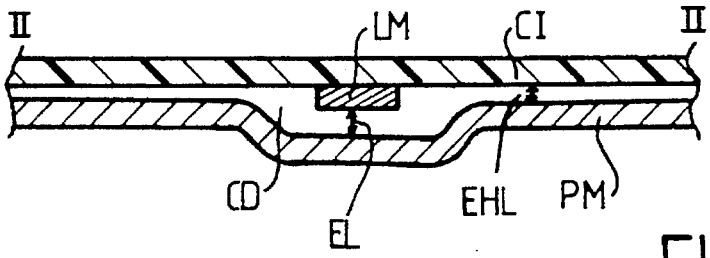
FIG. 2 is a partial cross sectional view, along the section line II—II (FIG. 4), of a microstrip line according to the invention.
Figure 3:
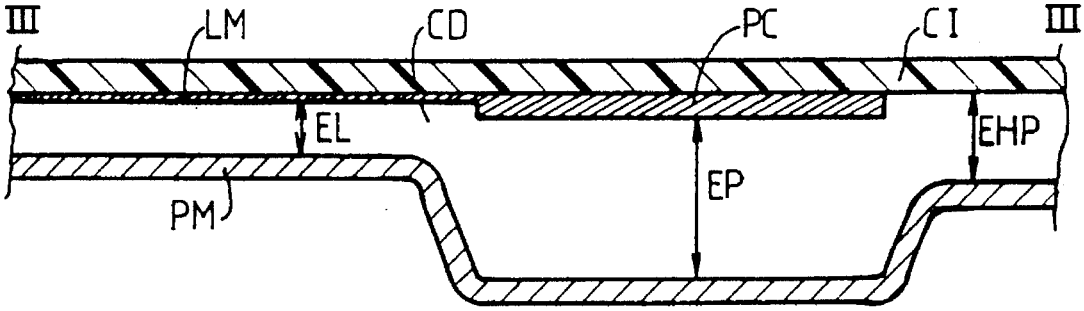
FIG. 3 is a partial cross sectional view, along the section line III—III (FIG. 4), of a conductive patch and microstrip line according to the invention.

With reference to FIGS. 1 to 3, the microstrip antenna device comprises, in a conventional manner, a dielectric layer CD, having on one side a conductive patch PC of a chosen shape, and on the other side a conductive plate forming ground plane PM.

The dielectric layer CD can, for example, consist of air.

The conductive patch is etched on a single-face printed circuit CI.

The conductive patch PC can, for example, be etched by microphotolithography. It consists of a material such as copper, which may, if required, be tin-plated or lacquered for better protection. It has a generally circular or rectangular shape. The substrate of the printed circuit CI consists of for example, a material based on glass and resin of the epoxy type.

A person skilled in the art will understand that the substrate of the printed circuit CI may advantageously serve here as a protective radome.

For reasons of cost, the glass-resin substrate is advantageously the one sold under the reference FR4.

Preferably, the microstrip feed line LM is also etched in the printed circuit CI according to a conventional microphotolithography process.

The ground plane PM is made from a metal plate of the dished sheet metal type, which is embossed to enable the thickness of the dielectric layer to be adapted in accordance with the radioelectrical areas opposite the said layer, in order to avoid increasing the width of the microstrip lines.

This adaptation of the thickness according to the invention is such that the thickness of the dielectric layer EP opposite the microstrip line EL is greater than the thickness opposite the periphery of said line EHL, while the thickness of the dielectric layer opposite the conductive patch PC is greater than the thickness opposite the periphery of said conductive patch EHP and opposite the microstrip line EL.

Such a structure makes it possible to simplify the antenna device appreciably, and thus to lower the cost of production.

For example, the width of the microstrip lines is about 4 mm for a characteristic impedance of 50 ohms with a thickness EL of about 1 mm of the dielectric layer opposite the microstrip line.

Such a structure finds an advantageous application in an antenna device comprising a network of patches interconnected to a UHF converter in a UHF receiver of satellite television signals.

Figure 4:
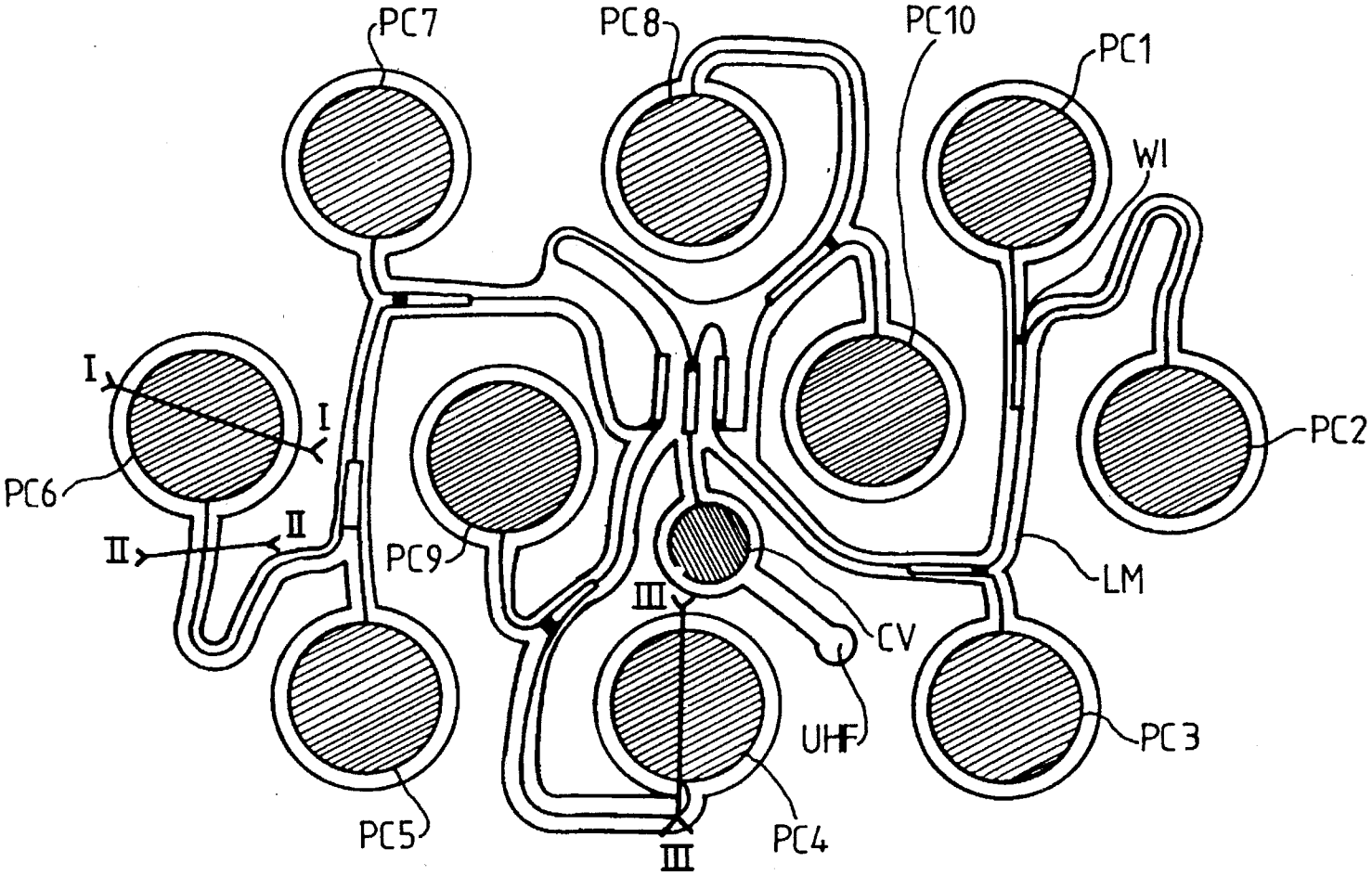
FIG. 4 is a plan view of ten conductive patches interconnected to a frequency converter according to the invention.

In FIG. 4, a network antenna device is shown which comprises a printed circuit on which the radiating patches are etched.

In the application in question, ten circular patches PC, referenced individually at PC1 to PC10, are etched on the printed circuit.

Microstrip transmission lines LM connect the different conductive patches to a frequency converter CV which can, for example, be implanted on the printed circuit CI by the CMS technology known as surface mounting.

In a conventional manner, dividers WI of the Wilkinson type with a decoupling resistor are provided to enable the various conductive patches PC to be connected to the frequency converter CV.

Preferably, the decoupling resistor of each divider WI of the Wilkinson type is implanted on a printed circuit in accordance with a CMS technology known as surface mounting.

Finally, a UHF connector of the coaxial type is located at the rear of the embossed metal sheet PM.

The frequency converter CV is, for example, capable of converting frequencies in a range from about 2308 to 2482 MHz to a frequency of about 470 to 646 MHz.

With such a structure, the Applicant has provided a receiver device operating at a centre frequency of about 2.39 GHz and with a usable frequency bandwidth of about 6 to 8%.

To achieve such a result, the width of the microstrip lines LM is about 4 mm, the thickness EP of the dielectric layer CD opposite the patch PC is about 5 mm, and the thickness EL is about 1 mm. The diameter of the conductive patches is about 52 mm.

Figure 1A:
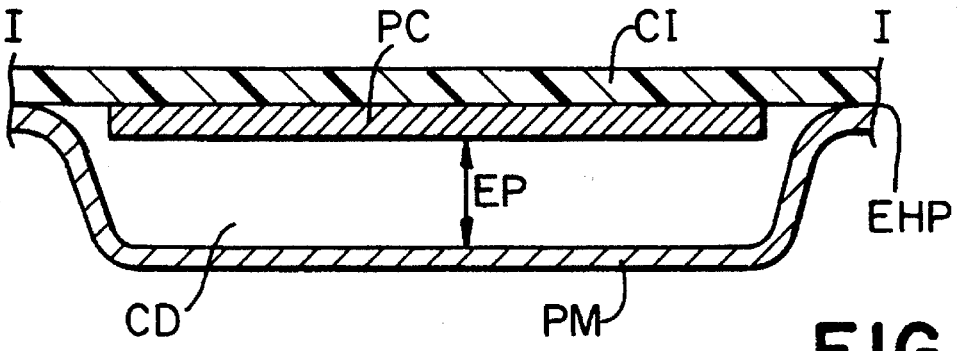
FIG. 1A shows the cross section of FIG. 1 in an alternative embodiment.
Figure 2A:
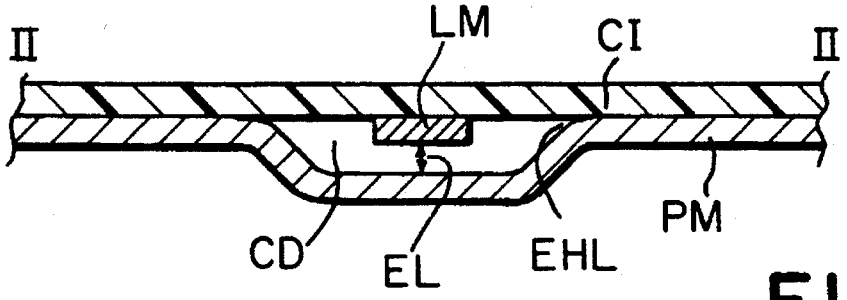
FIG. 2A shows the cross section of FIG. 2 in an alternative embodiment.

In a variant, shown in FIGS. 1A and 2A, the UHF converter is housed in a recess or dish in the ground plane.

In this structure, the thicknesses EHP and EHL are zero in so far as the dished metal sheet directly supports the printed circuit at places other than the patches and microstrip lines. These thicknesses may not be zero when the dielectric is not air, when a support is provided to support the printed circuit.

A person skilled in the art will understand that the production of such an antenna device can be achieved at low cost, which makes possible an application for the mass market, in particular for antenna devices for UHF reception of satellite television signals.

In the application concerning UHF reception of satellite television signals, the principal axis of the antenna device is generally directed towards the satellite.

In a variant, the object of the invention is, in general terms, an antenna device with a network of radiating elements, the principal axis of which is not permanently aimed at the satellite by virtue of its construction, and in which, at the level of the feed distributor of microstrip lines of the said radiating elements, an appropriate phase and/or time law is provided for.

Such a variant makes it possible to dispose a satellite reception antenna virtually anywhere, for example flat against the facade of a building or on its roof.

What is claimed is:

1. A microstrip antenna device comprising:

a dielectric layer, at least one conductive patch of a chosen shape on one side of the dielectric layer, and a conductive plate forming a ground plane on the other side of the dielectric layer; and a feed circuit comprising at least one microstrip line connected to the at least one conductive patch and implanted in the dielectric layer in the same plane as the at least one conductive patch, wherein the conductive plate forming the ground plane comprises an embossed metal plate opposite the conductive patch and the microstrip line so that the thickness of the dielectric layer opposite the microstrip line is greater than the thickness of the dielectric layer opposite the periphery of the microstrip line, wherein the conductive patch and the microstrip line are etched on a single printed circuit facing the dielectric layer and a substrate of the printed circuit acts as a radome, and wherein said conductive plate forming the ground plane directly supports the printed circuit at places other than the at least one conductive patch and the at least one microstrip line.

2. A device according to claim 1, wherein said substrate of the printed circuit comprises a material based on glass and a resin of the epoxy type.

3. A device according to claim 1, wherein said metal plate comprises a dished metal sheet.

4. A device according to claim 3, wherein the thicknesses of said dielectric layer opposite the periphery of said patch and the periphery of said microstrip line, respectively, are substantially zero, such that said dished sheet supports the printed circuit.

5. A device according to claim 1, wherein said dielectric layer comprises air.

6. A device according to claim 1, wherein the microstrip antenna comprises a network of said at least one patches implanted with their associated microstrip lines, implanted in the same printed circuit.

7. A UHF receiver comprising:

a microstrip antenna as recited in claim 6, and a frequency converter connected to receive signals from said microstrip antenna.

8. A UHF receiver comprising:

a microstrip antenna as recited in claim 6, wherein said feed circuit is connected to the network of patches to produce an antenna beam having a principal axis not permanently aimed at a target.

9. A device according to claim 8, wherein the target is a satellite.

10. A device according to claim 9, wherein said feed circuit conforms to a phase and/or time law corresponding to said antenna beam.

11. A device according to claim 1, wherein the thickness of the dielectric layer opposite the at least one conductive patch is greater than the thickness of the dielectric layer opposite the periphery of the at least one conductive patch and the thickness of the dielectric layer opposite the microstrip line.

* * * * *